US008657948B2

(12) United States Patent
Landis et al.

(10) Patent No.: US 8,657,948 B2
(45) Date of Patent: Feb. 25, 2014

(54) MODIFIED BENTONITES FOR ADVANCED FOUNDRY APPLICATIONS

(75) Inventors: Charles Landis, Houston, TX (US); Thomas Anderson, Dillsburg, PA (US); Eric Frantz, Houston, TX (US); Don Dell, The Woodlands, TX (US); Matthew Hilfiger, College Station, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/218,749

(22) Filed: Aug. 26, 2011

(65) Prior Publication Data

US 2011/0315335 A1 Dec. 29, 2011

Related U.S. Application Data

(62) Division of application No. 12/363,820, filed on Feb. 2, 2009, now abandoned.

(51) Int. Cl.
*C04B 14/00* (2006.01)

(52) U.S. Cl.
USPC ..... 106/400; 164/15; 164/529

(58) Field of Classification Search
None
See application file for complete search history.

(56) References Cited

U.S. PATENT DOCUMENTS

| | | | | | |
|---|---|---|---|---|---|
| 1,873,296 | A | * | 8/1932 | Cross | 502/63 |
| 2,072,212 | A | * | 3/1937 | Moosdorf et al. | 106/38.9 |
| 2,462,030 | A | * | 2/1949 | Whitehead | 106/688 |
| 3,046,146 | A | * | 7/1962 | Woodhead et al. | 106/38.51 |
| 3,050,796 | A | * | 8/1962 | Moore | 164/528 |
| 3,179,523 | A | * | 4/1965 | Moren | 106/38.35 |
| 3,219,580 | A | * | 11/1965 | Stratton | 507/135 |
| 3,654,151 | A | * | 4/1972 | King et al. | 106/487 |
| 3,657,134 | A | * | 4/1972 | King et al. | 106/503 |
| 3,671,190 | A | * | 6/1972 | Neumann | 423/331 |
| 3,947,392 | A | * | 3/1976 | Lang et al. | 523/139 |
| 4,242,140 | A | * | 12/1980 | Alther | 501/146 |
| 4,248,974 | A | * | 2/1981 | Fujii et al. | 521/91 |
| 4,321,186 | A | * | 3/1982 | Allison, III | 523/139 |
| 4,381,813 | A | * | 5/1983 | Kottke | 164/527 |
| 4,514,227 | A | * | 4/1985 | Szabo | 106/38.2 |
| 5,372,636 | A | | 12/1994 | Gray et al. | |
| 5,382,289 | A | * | 1/1995 | Bambauer et al. | 106/690 |
| 5,688,313 | A | * | 11/1997 | Landis | 106/38.2 |
| 5,695,554 | A | * | 12/1997 | Landis | 106/38.2 |
| 5,769,933 | A | * | 6/1998 | Landis | 106/38.2 |
| 5,810,918 | A | * | 9/1998 | Landis | 106/38.22 |
| 6,299,677 | B1 | * | 10/2001 | Johnson et al. | 106/38.2 |
| 7,255,731 | B2 | * | 8/2007 | Mentink | 106/162.1 |
| 2004/0244943 | A1 | * | 12/2004 | Eisenhour | 164/528 |
| 2005/0087323 | A1 | * | 4/2005 | Hathaway | 164/522 |
| 2005/0239662 | A1 | * | 10/2005 | Patel | 507/118 |
| 2008/0264301 | A1 | * | 10/2008 | Porat et al. | 106/668 |

FOREIGN PATENT DOCUMENTS

| | | | | |
|---|---|---|---|---|
| DE | 19643514 | A1 | | 4/1998 |
| EP | 0759334 | A2 | | 2/1997 |
| SU | 1156802 | A | * | 5/1985 |

OTHER PUBLICATIONS

Official Action for RU2011136464/02(054223) dated Jan. 21, 2013.
Odom, I.E., Smectite Clay Minerals: Properties and Uses, Phil. Trans. R. Soc. Lond. A 1984 311, doi: 10.1098/rsta. 1984.0036, published Jun. 14, 1984.

* cited by examiner

*Primary Examiner* — Kaj K Olsen
*Assistant Examiner* — Ross J Christie
(74) *Attorney, Agent, or Firm* — Holly Soehnge; McDermott Will & Emery LLP

(57) ABSTRACT

Methods of reducing the permeability of a subterranean formation to aqueous-based fluids using a water-soluble relative permeability modifier that comprises a hydrophobically modified polymer, wherein the hydrophobically modified polymer is a reaction product of: a hydrophilic polymer that comprises a polymer selected from the group consisting of a polyvinylamine, a poly(vinylamine/vinyl alcohol), and an alkyl acrylate polymer; and, a hydrophobic compound comprising at least one alkyl chain having a carbon chain length between about 4 and about 22 carbons. The water-soluble relative permeability modifier may be placed within a subterranean drilling operation such that the water-soluble relative permeability modifier attaches onto surfaces within the subterranean formation to effect permeability of aqueous fluids.

16 Claims, No Drawings

MODIFIED BENTONITES FOR ADVANCED FOUNDRY APPLICATIONS

This application is a divisional of U.S. patent application Ser. No. 12/363,820 filed on Feb. 2, 2009, entitled "Modified Bentonites for Advanced Foundry Applications," by Charles Landis, et al.

BACKGROUND

The present invention relates to compositions for producing foundry molds, and more specifically to foundry mold compositions incorporating a modifier for improved foundry molds.

In the casting of molten metals and alloys for various foundry applications, it is customary to employ foundry molds having a configuration conforming to the shape of the desired casting. Foundry molds made of sand may be used to form the outside of castings or may be cores, positioned inside the mold to shape the inside of the casting. Foundry molds may be constructed from compositions that include foundry sand as the major component in combination with a mineral clay and water. Supplemental additives may include ground bituminous coal, lignite, leonardite, pregelatinized starches, cellulose and other conventional additives may also be present in minor amounts. The foundry mold composition may be produced by introducing foundry sand, water, any supplemental additions, and the mineral clay into a mixing apparatus, such as a muller. The mixing of these constituents may be performed to an extent that the particles of the foundry sand are coated by the mineral clay component. The supplemental additives and the mineral clay may be added as a single mixture to the foundry sand and water in a mixing apparatus so that the sand particles may be coated with the mineral clay. Thereafter, the composition from the muller may be introduced to a flask or confining structure incorporating a pattern configured to correspond to the desired configuration of the metal or alloy casting. The composition may be consolidated within the pattern to obtain the required integrity, and then the pattern may be removed to render the foundry mold ready for use in producing a metal or alloy casting.

A significant property or characteristic of foundry mold compositions may be "durability" or the resistance of the mold and specifically the mineral clay component to thermal degradation at the elevated temperatures encountered during conventional hot metal and alloy casting. Specifically, it may be advantageous for the mold composition to be resistant to thermal degradation at temperatures ranging from 400° F. to 1200° F. Mineral clays may burn-out or lose their desired properties progressively as temperatures increase within this range. Sodium bentonite may exhibit greater durability compared to calcium bentonite in mold compositions. A second significant property may be the "dry strength" or the energy required to remove the solidified casting from the mold. In conventional foundry mold compositions containing blends of sodium bentonite and calcium bentonite, the dry strength property of the mold may be enhanced by increased amounts of calcium bentonite, which serves to reduce dry strength and facilitates easier removal of the casting from the sand mold. The calcium bentonite, however, may result in degradation of the durability of the mold. A third significant property may be "moldability" or the measurement of apparent cohesion between sand grains of the mold composition. Mold compositions deficient in this property may stick in hoppers and transfer equipment, which may be detrimental to the entire casting process. Mold compositions containing calcium bentonite as all or part of the mineral clay content may exhibit improved moldability, particularly when the water content of the mold composition increases. A fourth significant property may be "hot strength" or the ability of the mold composition to maintain its integrity at the mold composition/molten metal interface during and following pouring of the metal, usually at temperatures of 1500° F. and above. All of the additional, desired foundry mold properties may be attributed to equally by sodium bentonite or calcium bentonite or enhanced by sodium bentonite in the mold composition.

The additional properties include "green strength" or the strength or integrity of the mold prior to pouring of the molten metal into the mold. "Wet tensile strength" is the resistance of the mold to degradation due to transient shocks or jolts. "Hot deformation" is the ability of the mold to maintain dimensional stability during hot metal casting so that required dimensional tolerances are achieved with respect to the solidified casting. "Permeability" is defined as that property of a sand mold which allows gas to pass through it: The venting qualities of molds and cores depend upon this property. Permeability is influenced by the size, shape and distributing of the grains of the sand, the type and quantity of bonding material, the density to which the sand is rammed and the moisture content. "Friability" is a measure of the abrasion resistance of a sand mold. A friable sand is a sand that is not able to withstand the erosive flow of the molten metal. It will lose sand grains to the moving stream, and will be subject to producing erosion and inclusion defects. Generally, friability is inversely related to compactability; the lower the compactability, the higher the friability.

SUMMARY

The present invention relates to compositions for producing foundry molds, and more specifically to foundry mold compositions incorporating a modifier for improved foundry molds.

An embodiment of the present invention provides a composition for use in producing a foundry mold. The composition has a binder, wherein the binder comprises a smectite clay, a modifier, wherein the modifier comprises a metal carbonate, and a foundry sand.

An embodiment of the present invention provides a foundry mold comprising. The foundry mold composition has a binder comprising a smectite clay, a modifier comprising a metal carbonate, and a foundry sand.

An embodiment of the present invention provides a method for producing a foundry mold. The method comprises mixing and coating foundry sand with a binder, water, and a modifier to form a foundry mold composition, wherein the binder comprises a smectite clay and the modifier comprises a metal carbonate; introducing the foundry mold composition into a pattern defining a foundry mold; consolidating the foundry mold composition within the pattern to form the foundry mold; and removing the foundry mold from the pattern.

An embodiment of the present invention provides a method for viscosifying a fluid. The method comprises providing a fluid composition, wherein the fluid composition comprises a clay and a liquid; providing a modifier, wherein the modifier comprises a metal carbonate; and combining the fluid composition with the modifier to form a viscosified fluid.

An embodiment of the present invention provides a method of producing a foundry mold composition. The method comprises obtaining a metal carbonate by mining a naturally occurring mineral comprising the metal carbonate; processing the naturally occurring mineral into a particle; mixing and coating a foundry sand with a binder, water, and the particle to form a foundry mold composition, wherein the binder comprises a smectite clay.

The features and advantages of the present invention will be apparent to those skilled in the art. While numerous changes may be made by those skilled in the art, such changes are within the spirit of the invention.

DETAILED DESCRIPTION

The present invention relates to compositions for producing foundry molds, and more specifically to foundry mold compositions incorporating a modifier for improved foundry molds.

There are many advantages present in various embodiments, only some of which will be discussed herein. Some embodiments are directed to an additive for providing a desired cation exchange to modify smectite clay binders in foundry mold compositions. Metal carbonates may be useful in providing a source of metal cations for carrying out the exchange. For example, magnesium carbonates or magnesium calcium carbonates may be useful for providing a source of magnesium useful in carrying out a cation exchange of sodium or calcium in smectite clays. The metal carbonates may be naturally occurring and may be used without any substantial chemical processing. For example, magnesium carbonate may form a mineral commonly referred to as magnesite and magnesium calcium carbonate may form a mineral commonly referred to as dolomite. These minerals may be mined and processed into a reactive powder. Further, the use of naturally occurring minerals may allow for the desired cation exchange while also presenting an economically attractive alternative to more costly manufactured additives.

Foundry molds may be produced using a foundry mold composition, which may include the modifier disclosed herein. The foundry mold composition may include a foundry sand combined with a binder (e.g., a clay), a modifier, and water. The binder may act to consolidate the foundry sand during use, allowing the mold to hold its shape during production of the metal component. The modifier may react with the binder to alter the foundry properties of the foundry mold. Other additives may be present in some embodiments and may help to compensate for such effects as the thermal expansion of the sand during use. Each of these components will be described in more detail below.

In one embodiment, one or more binders may be used to consolidate the foundry mold composition to form a foundry mold. As used herein, the term "consolidate" is intended to refer to any process capable of forming a substantially conglomerated material in a desired shape. Any binder ordinarily used to consolidate foundry sands can be used with the foundry sands disclosed herein to enable the sand to retain a predetermined or desired shape as a mold or core material. For example, the binder may include a clay, such as smectite clay. In an embodiment, a smectite clay may be sodium bentonite, which may contain sodium in addition to the components magnesium, aluminum and silica. Additional species of smectite clay are hectorite and saponite; all of these species naturally occur in quantities sufficient to render them economically practical for use in the production of foundry mold compositions. The additional species nontronite, beidellite, or sauconite may be suitable for achieving a desired combination of foundry mold properties. Other species of clay such as kaolinite or illite may be used as binders in combination with the smectite clays. Sodium bentonite may consist of about 70 to 95% montmorillonite, with the balance being various residual constituents, such as quartz, opal, cristobalite, feldspar, biotite, clinoptilite, calcite, gypsum and the like. Any smectite clay species, such as bentonite, may be employed with the normal residual constituents or in the case of bentonite with the constituents substantially removed with only montmorillonite being present. Consequently, the terms "sodium-containing smectite clay" and "sodium bentonite" include these clays with the normal residual constituents either being present or removed.

The crystal structure of smectite clay species, including bentonite, may constitute a three-layer sheet structure. The upper and lower layers of the sheet structure may be silica with the middle plate being a metal layer of at least two of the metals aluminum, iron, lithium, manganese and magnesium. The interlayer space may contain sodium or calcium. The morphology of any species of smectite clay may constitute a stacked plate structure of the three-layer sheets.

This three-layer sheet structure may permit delamination and dispersion of the smectite clay during mixing and reaction thereof with water and foundry sand to permit substantially complete reaction of the smectite clay with the modifier to achieve a desired combination of foundry mold properties. As used herein, the reaction of the binder with the modifier refers to a cation exchange between one or more metals in the binder with one or more metals in the modifier to create a foundry mold composition with improved foundry properties. Specifically, the presence of the modifier and the reaction thereof with the binder may be used to achieve the desired combination of optimum durability and dry strength, along with other properties attributable to the presence of sodium containing smectite clay. For example, upon combining a binder comprising calcium and sodium bentonite with a modifier comprising magnesium carbonate or calcium magnesium carbonate, the magnesium cations generated in the solution may be exchanged with the calcium and sodium cations to impart improved foundry properties to the resulting foundry mold composition. This reaction may improve the dry strength of the composition as is conventionally achieved with the presence of calcium-containing smectite clay without degrading the durability achieved by the presence of sodium-containing smectite clay. The reaction may also improve the desirable foundry properties attributed to the presence of sodium-containing smectite clay.

The amount of the binder used in the foundry mold composition generally depends upon the particular type of sand used in the mixture and the temperature of tiring. Silica sand grains expand upon heating. When the grains are too close, the molding sand may move and expand causing the castings to show defects such as "buckles" or deformity in the casting resulting from excessive sand expansion, "rat tails" or rough, irregular depressions that appear on the surface of a casting or a minor buckle, and "scabs" or breaking away of a portion of the molding sand when hot metal enters the mold. To overcome this harmful expansion, more binder may be added to the sand mixture, which may compensate for the expansion of the silica sand grains through contraction of the clay upon firing.

In green sand molding, the reproducibility of the dimensions obtained in the casting may be the result of such factors as shrinkage, changes in dimensions of the mold cavity, the hardness of the mold, the stability of the molding sand, the mechanical alignment of the flask, and the stability of the temperature in the mold. Sodium bentonite bonded molding sands may have a more gummy feel than calcium bentonite bonded sand mixtures when the temper water is added and mulled into sand mixtures. Sodium bentonite sand mixtures are said to be tougher and not as brittle as calcium bentonite or Fuller's Earth bonded molding sands prepared in the same manner. In one embodiment, the binder may generally be present in amounts of about 1% to about 15% based on the total dry weight of the foundry mold composition and may be adjusted to any amount that will produce the desired strength, hardness, or other desirable physical property. In another embodiment, the binder may be used in an amount of about 2% to about 12% by weight based on the dry weight of the total sand content. It is understood in the foundry industry that by adding more clay binder to a foundry sand mixture, more water is generally required. Therefore, it is often the case that by using less clay binder in a foundry sand mixture and reducing the amount of temper water added, the foundry sand mixture may be just as strong as it was with higher percentages of clay binder and water.

In an embodiment, a modifier may be used to chemically alter the binder in order to create a foundry mold with desired foundry properties. In an embodiment, the modifier may be a metal carbonate capable of reacting with the smectite clay to promote a favorable cation exchange of a metal ion for the sodium or calcium ions in the smectite clays. The use of specific metal carbonates may be useful in promoting selective ion exchanges of a specific metal cation with the sodium or calcium cations in the smectite clay. The metal component in the metal carbonates may include, but are not limited to, aluminum, calcium, iron, potassium, magnesium, boron, zinc, lead, copper or a combination thereof. For example, magnesium carbonate may be used to modify a smectite clay (e.g., sodium or calcium bentonite) to promote a favorable cation exchange of magnesium for the sodium or calcium in the clay. Similarly, calcium magnesium carbonate may be used to promote a cation exchange of magnesium cations for the sodium or calcium cations in the smectite clay. The metal carbonates may come from any source, including any naturally occurring source such as a naturally occurring mineral. Magnesium carbonate may form the mineral commonly referred to as magnesite and calcium magnesium carbonate may form the mineral commonly referred to as dolomite. These naturally occurring minerals may be used with the foundry mold compositions by physical processing to form a desired particle size. In addition, these minerals may be used without being substantially chemically altered from their natural occurring state. The metal carbonates disclosed herein may be used in either an anhydrous or hydrated form. For example, dolomite (i.e., calcium magnesium carbonate) may be described as a hydrate of calcium magnesium carbonate. In an embodiment, the metal carbonates may be obtained by mining a naturally occurring mineral containing at least some metal carbonate and processing the naturally occurring mineral into a desired particle size before incorporating the particle into the foundry mold compositions disclosed herein.

The metal carbonates may generally be processed such that they are powderized and added to the foundry mold composition in a sufficient amount to react with a binder. In general, the metal carbonates may be a solid processed to a size approximately equal to that of the binder with which they are combined. The metal carbonates may be processed using any well known technique to produce a powder from a starting material. For example, the metal carbonate may be crushed or milled to form a powder that may react with the binder. In an embodiment, the metal carbonate may have a particle size of less than about 2 millimeters. In another embodiment, the metal carbonate may have a particle size ranging from about 40 micrometers to about 75 micrometers. The metal carbonate may be added in an amount sufficient to create a desired cation exchange, which may in turn create desired foundry properties in the foundry mold. In an embodiment, the processed metal carbonates may be added to the foundry mold composition in an amount ranging from about 0.1% to about 20% by weight of the foundry mold composition. In another embodiment, the processed metal carbonates may be added to the foundry mold mixture in an amount ranging from about 0.5% to about 5% by weight of the foundry mold composition.

In an embodiment, the foundry mold may comprise a sand. The sand may be any sand capable of forming a foundry mold and retaining its shape when exposed to the high temperatures associated with hot metal and alloy casting. In an embodiment, the sand may be a silica sand, olivine sand, chromite sane, zircon sand, carbon sand, ceramic sand, or any combination thereof.

Silica sand may be relatively inexpensive and may be used in a variety of foundry mold compositions for various purposes. Olivine sand may be more expensive than silica sand but may have better thermal stability, providing higher quality castings. As such, olivine sand may be useful with non-ferrous metal compositions.

Spherical or ovoid grain, carbon or coke particles, known to the trade as petroleum fluid coke, may also be used as foundry sands alone, in combination with, or in place of silica and olivine sands, which may not have the physical properties entirely satisfactory for casting metals such as aluminum, copper, bronze, brass, iron and other metals and alloys. Each of these spherical or ovoid grain fluid coke carbon sand may also be useful, alone or in combination, with other types of foundry sands and the foundry sand additives disclosed herein.

Other sands may also be useful. Roasted carbon sand is a low-cost carbon sand designed primarily for low melting temperature metals, such as aluminum and magnesium. Roasting at 1300°-1400° F., may remove substantially all of the volatile matter which would otherwise be evolved if raw fluid coke were exposed to aluminum poured at 1400° F. Chromite and zircon are oxide minerals that may be processed to an appropriate size to be used as sands in foundry molds. A ceramic sand may also be used alone or in combination with other sands.

In an embodiment, the sand may be present in the foundry mold mixture in an amount sufficient to create a foundry mold that may maintain its shape during the pouring of molten metal compositions. In general, the sand may be present in an amount ranging from about 40% to about 99% by weight of the total foundry mold composition. This amount may vary depending on the total amount of other additives included in the foundry mixture.

In an embodiment, the foundry mold composition may comprise other additives. For example, additional binders may be used with the smectite clay. Some of the optional binders which may be used in the foundry sand include starches, sugars, core oils, sodium silicates, thermoplastic and thermosetting resins, vapor-curing binders, chemically-curing binders, heat-curing binders, pitches, resins, cements and various others known in the art. Other optional additives may include additional clays (e.g., china clay), and oils (e.g., linseed oil and the like). In an embodiment, the additives may be included in an amount of about 0% to about 10% by dry weight of the sand. In another embodiment, these additional additives may be included in amounts of less than about 1.0% by dry weight of the sand.

Other additives may also be useful in the foundry mold composition and may optionally be included to achieve various properties. Common additives for the foundry sand compositions may include cellulose, cereal, or other fibrous additives included for the purpose of overcoming sand expansion defects, particularly those defects occurring on flat casting surfaces, in an amount of about 0.5% to about 5% by weight of the dry sand composition. Typical cellulose additives may include, but are not limited to, wood flour and cereals such as dry flour, wheat flour, corn flour, oat hulls, rice hulls, alfalfa fines, grain chaff, flax seed pressings, corn cob flour, pulverized nut hulls, ground cotton-seed pulp after oil extraction, and the like. Cements (e.g., Portland cement), natural cements (e.g., heated, ground limestone), resins, and the like in amounts of about 3% to about 6% by weight of the dry sand also may be added to foundry sand binders of the present invention.

Various other additives may be included in the foundry sand compositions, such as various blackings or other carbonaceous materials (e.g., graphite), pitch; charcoal; bituminous coal; soft coal (e.g., seacoal); hard coal; and coke which can be used with, or as a partial clay substitute for wet coating to prevent metal penetration or burn-on.

In an embodiment, the method of preparing the foundry mold composition may be performed by any method known to one skilled in the art. For example, a muller may be used to prepare the foundry mold composition. The muller may combine water, sand, a binder, and a modifier to form the foundry mold composition. The muller may generally have an opposed pair of stone mixing wheels mounted on opposite ends of a shaft connected to and rotated by a drive shall, which may be connected in driving engagement with a motor. The constituents introduced to the muller may be mixed by the action of the stone wheels in a manner well known in the art so that the binder and modifier may react, and the sand particles may be coated with the reaction product, the water, and any supplemental additives when desired.

Once the mixture has reacted and been combined, the resulting foundry mold composition may be discharged from the muller and poured into a flask having a pattern. In an embodiment, the pattern may be configured to define a cavity desired in the foundry mold. The mold cavity may conform to the configuration desired in the metal casting. This process may be used to prepare a two part mold, sometimes called a split pattern mold. A split pattern may have a top or upper section, called a cope, and a bottom or lower section called a drag. The method of producing the mold may also be used to form a core to be inserted to complete the final part shape.

A ram may be used to compress and consolidate the composition within the pattern to form a foundry mold. The pattern may intentionally be made larger than the cast part to allow for shrinkage during cooling. Thereafter, the pattern may be removed to expose the foundry mold, which may or may not have a mold cavity. In another embodiment, the foundry mold may be removed while the pattern remains stationary. If a split pattern is used, the cope and drag may be engaged and any cores can then be inserted in the mold to create holes and improve the casting's net shape. Molten metal may either be poured into an open mold or into an opening called a gate for a split pattern mold. If necessary, vent holes may allow hot gases to escape during the pour. The pouring temperature of the metal may be above the melting point to assure good fluidity, thereby avoiding prematurely cooling, which will cause voids and porosity. When the metal cools, the sand mold is removed to expose the metal casting.

In an embodiment, the modifiers disclosed herein may also be used to improve the rheological properties of a clay mixture. The rheological properties useful in describing the present invention include, but are not limited to, yield point ("YP"), low-shear viscosity, plastic viscosity ("PV"), and gel strength. The YP is the yield stress extrapolated to a shear rate of zero. Similarly, yield stress is the stress that must be applied to a material to make it begin to flow (or yield), and is commonly measured using a rheometer rotating at a rate of 3 to 6 revolutions per minute ("rpm"). PV represents the viscosity of a fluid when extrapolated to infinite shear rate and is usually determined as the difference between the shear reading at 600 rpm and the shear reading at 300 rpm using a viscometer.

The modifiers of the present invention may be added to a clay mixture and combined with a liquid, such as water, to viscosify the resulting fluid: In an embodiment, the modifiers disclosed herein may be used to improve, among other properties, the plastic viscosity and the yield point of a fluid to which the modifier is added. In an embodiment, a modifier may act as a viscosifier in a fluid to which it is added such that the yield point may be above about 150 lb/100 $ft^2$. In an embodiment, a modifier may act as a viscosifier to a fluid to which it is added such that the plastic viscosity of a fluid to which it is added is above about 10 centipoise.

In an embodiment, the modifiers disclosed herein may be added to a composition in an amount ranging from about 0.1% to about 20% by weight of the composition in order to impart improved rheological properties. In another embodiment, the modifiers may be added to a composition in an amount ranging from about 0.5% to about 5% by weight of the composition.

To facilitate a better understanding of the present invention, the following examples of certain aspects of some embodiments are given. In no way should the following examples be read to limit, or define, the scope of the invention.

EXAMPLES

The following examples are submitted for the purpose of demonstrating the characteristics of the foundry mold compositions as disclosed herein. These tests were conducted substantially in accordance with the procedures described in the American Foundrymen's Society Mold and Core Handbook, 3d. ed., copyright 2001. Specific test methods include the use of AFS 2220-00-S to measure the compactability of the samples, AFS 5222-00-S to measure the specimen weight, AFS 2219-00-S to measure the moisture content of the sample, AFS 5202-00-S to measure the green and dry compressive strength of the sample, AFS 5224-00-S to measure the permeability of the sample, and AFS 2248-00-S to measure the friability of the sample, which method was modified to measure the moldability of the sample.

As used in these examples, National® Standard ("N.S. 200") is a sodium bentonite green sand binder available from Bentonite Performance Minerals, L.L.C. of Houston, Tex.

Baramix® is a mixed, single-package foundry binder consisting of National® Standard bentonite, sea coal, and, depending on customer requirements, dextrin, gilsonite, wood flour, and other additives that may be required. Baramix® is available from Bentonite Performance Minerals, L.L.C. of Houston, Tex.

Example 1

Seven foundry mold compositions were prepared according to the methods disclosed herein and labeled Samples 1 through 7. The seven samples were prepared by combining a sodium bentonite (National® Standard) binder with water, foundry sand, and a modifier in the amounts indicated in Tables 1 through 3. In this example, a naturally occurring hydrate of a calcium magnesium carbonate (i.e., a dolomite hydrate) was used as the modifier. Each sample was tested at three different compactability values to measure various foundry properties. In addition, another portion of the sample was tested to determine its rheological properties. The rheological properties were measured using a Fantle viscometer model 35A, available from Fann Instrument Company, Houston U.S.A. The resulting desirable foundry properties are shown in Tables 1 through 4.

TABLE 1

Foundry Properties of Foundry Mold Compositions Including a Calcium Magnesium Carbonate Modifier With a 35% Compactability Target

| Sample ID | 1 | 2 | 3 | 4 | 5 | 6 | 7 | AVG |
|---|---|---|---|---|---|---|---|---|
| base clay | N.S. 200 | N.S. 200 | N.S. 200 | N.S. 200 | N.S. 200 | N.S. 200 | N.S. 200 | N.S. 200 |
| Binder in Sand (%) | 8.0 | 8.0 | 8.0 | 8.0 | 8.0 | 8.0 | 8.0 | 8.0 |
| Water in Sand (%) | 2.03 | 2.03 | 2.10 | 2.07 | 2.10 | 2.10 | 2.10 | 2.08 |
| Dolomite Hydrate in Binder (%) | 2.0 | 2.0 | 2.0 | 2.0 | 2.0 | 2.0 | 2.0 | 2.0 |
| Compactability (%) | 35.8 | 35.0 | 35.8 | 34.2 | 35.0 | 34.2 | 35.0 | 35.0 |
| Specimen Weight (grams) | 159.00 | 157.00 | 158.00 | 158.25 | 159.00 | 159.00 | 159.00 | 158.46 |
| Moisture (%) | 2.49 | 2.54 | 2.60 | 2.57 | 2.45 | 2.58 | 2.61 | 2.55 |
| Average Green Comp Str. (psi) | 23.0 | 24.9 | 23.5 | 23.9 | 23.5 | 23.6 | 24.1 | 23.8 |
| Total Dry Comp Str. (psi) | 65.5 | 75.7 | 65.7 | 59.0 | 65.0 | 62.4 | 62.7 | 65.14 |
| Permeability (psi) | 130 | 123 | 102 | 91 | 140 | 203 | 201 | 141.43 |
| Friability (%) | — | 15.84 | 13.80 | 15.05 | 13.92 | 14.39 | 13.78 | 14.46 |
| Moldability (%) | — | 73.56 | 85.28 | 91.27 | 96.59 | 92.15 | 89.60 | 88.08 |

TABLE 2

Foundry Properties of Foundry Mold Compositions Including a Calcium Magnesium Carbonate Modifier With a 40% Compactability Target

| Sample ID | 1 | 2 | 3 | 4 | 5 | 6 | 7 | AVG |
|---|---|---|---|---|---|---|---|---|
| base clay | N.S. 200 | N.S. 200 | N.S. 200 | N.S. 200 | N.S. 200 | N.S. 200 | N.S. 200 | N.S. 200 |
| Binder in Sand (%) | 8.0 | 8.0 | 8.0 | 8.0 | 8.0 | 8.0 | 8.0 | 8.0 |
| Water in Sand (%) | 2.20 | 2.20 | 2.27 | 2.27 | 2.27 | 2.27 | 2.27 | 2.25 |
| Dolomite Hydrate in Binder (%) | 2.0 | 2.0 | 2.0 | 2.0 | 2.0 | 2.0 | 2.0 | 2.0 |
| Compactability (%) | 41.7 | 41.7 | 39.2 | 40.0 | 39.2 | 40.0 | 40.0 | 40.2 |
| Specimen Weight (grams) | 159.00 | 158.00 | 158.25 | 159.00 | 159.00 | 159.00 | 159.00 | 158.75 |
| Moisture (%) | 2.67 | 2.61 | 2.74 | 2.66 | 2.68 | 2.70 | 2.74 | 2.69 |
| Average Green Comp Str. (psi) | 21.9 | 22.0 | 22.4 | 22.3 | 22.8 | 23.1 | 23.2 | 22.5 |
| Total Dry Comp Str. (psi) | 76.2 | 79.1 | 68.7 | 67.8 | 73.0 | 70.6 | 67.7 | 71.87 |
| Permeability (psi) | 122 | 180 | 104 | 104 | 101 | 201 | 204 | 145.14 |
| Friability (%) | — | 12.80 | 11.01 | 9.72 | 12.23 | 10.63 | 9.72 | 11.02 |
| Moldability (%) | — | 77.99 | 83.35 | 75.05 | 81.94 | 89.92 | 84.76 | 82.17 |

TABLE 3

Foundry Properties of Foundry Mold Compositions Including a Calcium Magnesium Carbonate Modifier With a 45% Compactability Target

| Sample ID | 1 | 2 | 3 | 4 | 5 | 6 | 7 | AVG |
|---|---|---|---|---|---|---|---|---|
| base clay | N.S. 200 | N.S. 200 | N.S. 200 | N.S. 200 | N.S. 200 | N.S. 200 | N.S. 200 | N.S. 200 |
| Binder in Sand (%) | 8.0 | 8.0 | 8.0 | 8.0 | 8.0 | 8.0 | 8.0 | 8.0 |
| Water in Sand (%) | 2.33 | 2.33 | 2.43 | 2.43 | 2.40 | 2.40 | 2.40 | 2.39 |
| Dolomite Hydrate in Binder (%) | 2.0 | 2.0 | 2.0 | 2.0 | 2.0 | 2.0 | 2.0 | 2.0 |
| Compactability (%) | 46.7 | 45.8 | 44.2 | 47.5 | 45.8 | 45.0 | 45.8 | 45.8 |
| Specimen Weight (grams) | 159.00 | 158.00 | 158.25 | 159.00 | 159.00 | 159.00 | 159.00 | 158.75 |
| Moisture (%) | 2.74 | 2.58 | 2.83 | 2.84 | 2.81 | 2.88 | 2.77 | 2.78 |
| Average Green Comp Str. (psi) | 20.8 | 21.1 | 21.2 | 21.1 | 21.9 | 22.0 | 21.8 | 21.4 |
| Total Dry Comp Str. (psi) | 75.8 | 63.4 | 80.0 | 77.2 | 78.0 | 77.2 | 74.5 | 75.16 |
| Permeability (psi) | 105 | 200 | 83 | 105 | 100 | 207 | 205 | 143.57 |
| Friability (%) | 9.81 | 9.96 | 7.85 | 7.92 | 9.82 | 8.76 | 9.52 | 9.09 |
| Moldability (%) | 75.56 | 72.17 | 74.21 | 70.01 | 78.01 | 80.35 | 77.06 | 75.34 |

TABLE 4

Rheological Properties of Foundry Mold Composition With 2% by weight Calcium Magnesium Carbonate Modifier

| | | | | | | | | |
|---|---|---|---|---|---|---|---|---|
| base clay | N.S. 200 | N.S. 200 | N.S. 200 | N.S. 200 | N.S. 200 | N.S. 200 | N.S. 200 | N.S. 200 |
| Sample ID | 1 | 2 | 3 | 4 | 5 | 6 | 7 | AVG |
| D.I. water, bbl | 1 | 1 | 1 | 1 | 1 | 1 | 1 | 1 |
| lb/bbl clay blend | 22.5 | 22.5 | 22.5 | 22.5 | 22.5 | 22.5 | 22.5 | 22.5 |
| wt % dolomite hydrate | 2.0 | 2.0 | 2.0 | 2.0 | 2.0 | 2.0 | 2.0 | 2.0 |
| Fann 35A readings: | | | | | | | | |
| 600 rpm | 210.0 | 230.0 | 190.0 | 205.0 | 195.0 | 180.0 | 187.0 | 202 |
| 300 rpm | 199.0 | 223.0 | 175.0 | 194.0 | 187.0 | 175.0 | 172.0 | 192 |
| 200 rpm | 196.0 | 210.0 | 168.0 | 187.0 | 180.0 | 167.0 | 164.0 | 185 |
| 100 rpm | 182.0 | 203.0 | 157.0 | 179.0 | 167.0 | 153.0 | 149.0 | 174 |
| 6 rpm | 114.0 | 132.0 | 100.0 | 110.0 | 105.0 | 98.0 | 93.0 | 110 |
| 3 rpm | 95.0 | 100.0 | 85.0 | 68.0 | 70.0 | 65.0 | 59.0 | 81 |
| Plastic viscosity, cP | 11.0 | 7.0 | 15.0 | 11.0 | 8.0 | 5.0 | 15.0 | 10 |
| Yield point, lb/100 $ft^2$ | 188.0 | 216.0 | 160.0 | 183.0 | 179.0 | 170.0 | 157.0 | 183 |
| Apparent Viscosity, cP | 105.0 | 115.0 | 95.0 | 102.5 | 97.5 | 90.0 | 93.5 | 101 |
| TP/PV ratio | 17.1 | 30.9 | 10.7 | 16.6 | 22.4 | 34.0 | 10.5 | 22 |

Example 2

Five foundry mold compositions were prepared according to the methods disclosed herein and labeled Samples 8 through 12. The first sample, labeled sample 8, contained only sand, a clay binder, and water in order to demonstrate an unmodified foundry mold composition. The next three samples, labeled samples 9, 10, and 11, contained a similar formulation with the addition of varying amounts of a calcium magnesium carbonate modifier in order to demonstrate the effects of the modifier in different concentrations. The last sample, labeled sample 12, contained the same formulation as sample 8 with the addition of a magnesium oxide modifier for comparison to the carbonate modifier. The formulations of each sample are shown in Tables 5 through 7. Each sample was tested at three different compactability values to measure various foundry properties. The resulting desirable foundry properties are shown in Tables 5 through 7.

TABLE 5

Foundry Properties of Foundry Mold Compositions With a 35% Compactability Target

| Sample ID | 8 | 9 | 10 | 11 | 12 |
|---|---|---|---|---|---|
| Base Clay | N.S. 200 | N.S. 200 | N.S. 200 | N.S. 200 | N.S. 200 |
| Binder in Sand (%) | 8.0 | 8.0 | 8.0 | 8.0 | 8.0 |
| Water in Sand (5) | 1.83 | 2.03 | 2.03 | 2.07 | 2.03 |
| MgO in Binder (%) | — | — | — | — | 2.6 |
| Dolomite Hydrate in Binder (%) | — | 1.8 | 2.0 | 2.3 | — |
| Compactability (%) | 33.3 | 35.00 | 32.50 | 33.33 | 33.3 |
| Specimen Weight (grams) | 158.00 | 158.00 | 158.00 | 158.00 | 158.00 |
| Moisture (%) | 2.30 | 2.32 | 2.40 | 2.52 | 2.45 |
| Average Green Comp Str. (psi) | 25.2 | 24.2 | 23.3 | 24.4 | 24.9 |
| Total Dry Comp Str. (psi) | 66.5 | 68.0 | 59.1 | 58.1 | 53.0 |
| Permeability (psi) | 170 | 170.00 | 178.00 | 175.00 | 175 |
| Friability (%) | 18.77 | 13.93 | 13.75 | 15.01 | 16.99 |
| Moldability (%) | 91.24 | 92.29 | 92.16 | 92.76 | 89.68 |

TABLE 6

Foundry Properties of Foundry Mold Compositions With a 40% Compactability Target

| Sample ID | 8 | 9 | 10 | 11 | 12 |
|---|---|---|---|---|---|
| Base Clay | N.S. 200 | N.S. 200 | N.S. 200 | N.S. 200 | N.S. 200 |
| Binder in Sand (%) | 8.0 | 8.0 | 8.0 | 8.0 | 8.0 |
| Water in Sand (5) | 1.97 | 2.17 | 2.20 | 2.27 | 2.17 |
| MgO in Binder (%) | — | — | — | — | 2.6 |
| Dolomite Hydrate in Binder (%) | — | 1.8 | 2.0 | 2.3 | — |
| Compactability (%) | 39.2 | 40.00 | 39.17 | 40.00 | 40.8 |
| Specimen Weight (grams) | 158.00 | 158.00 | 158.00 | 158.00 | 158.00 |
| Moisture (%) | 2.33 | 2.59 | 2.65 | 2.64 | 2.55 |
| Average Green Comp Str. (psi) | 23.5 | 23.0 | 22.7 | 22.7 | 24.0 |
| Total Dry Comp Str. (psi) | 76.5 | 71.5 | 67.6 | 66.0 | 52.7 |
| Permeability (psi) | 175 | 175.00 | 180.00 | 175.00 | 175 |
| Friability (%) | 12.36 | 13.38 | 9.99 | 10.27 | 11.41 |
| Moldability (%) | 85.76 | 86.11 | 83.25 | 84.04 | 86.89 |

TABLE 7

Foundry Properties of Foundry Mold Compositions With a 45% Compactability Target

| Sample ID | 8 | 9 | 10 | 11 | 12 |
|---|---|---|---|---|---|
| Base Clay | N.S. 200 | N.S. 200 | N.S. 200 | N.S. 200 | N.S. 200 |
| Binder in Sand (%) | 8.0 | 8.0 | 8.0 | 8.0 | 8.0 |
| Water in Sand (5) | 2.10 | 2.30 | 2.33 | 2.40 | 2.30 |
| MgO in Binder (%) | — | — | — | — | 2.6 |
| Dolomite Hydrate in Binder (%) | — | 1.8 | 2.0 | 2.3 | — |
| Compactability (%) | 47.5 | 45.00 | 44.17 | 45.00 | 45.0 |
| Specimen Weight (grams) | 158.00 | 158.00 | 158.00 | 158.00 | 158.00 |
| Moisture (%) | 2.55 | 2.64 | 2.73 | 2.76 | 2.68 |
| Average Green Comp Str. (psi) | 21.3 | 21.7 | 22.5 | 22.6 | 23.2 |
| Total Dry Comp Str. (psi) | 75.5 | 74.5 | 72.7 | 67.8 | 45.5 |
| Permeability (psi) | 180 | 190.00 | 190.00 | 182.00 | 185 |
| Friability (%) | 10.21 | 8.82 | 8.58 | 8.68 | 9.66 |
| Moldability (%) | 70.10 | 78.91 | 73.45 | 85.03 | 78.16 |

The results demonstrate the improved foundry properties of the foundry mold compositions using a modifier disclosed herein. Samples 9, 10, and 11 demonstrate improved friability, permeability, and moldability relative to Sample 8, which has no modifier present, in all cases except for the 40% compactability target. Samples 9, 10, and 11 also demonstrate improved permeability and friability relative to Sample 12 which utilizes magnesium oxide as a modifier. The results also demonstrate that the amount of modifier in the foundry mold composition may be varied in order to obtain a desired set of foundry properties.

Example 3

Four foundry mold compositions were prepared according to the methods disclosed herein and labeled Samples 13 through 16. The samples contained additional components to demonstrate the foundry properties of the compositions with common foundry composition additives and was based on the Baramix® foundry binder mixture available from Bentonite Performance Minerals, L.L.C. of Houston, Tex. The samples contained sand, a clay binder, water, gasoline, and coal in addition to either a carbonate modifier or a magnesium oxide for comparison. Samples 15 and 16 each contained wood flour as an additional additive. The formulations of each sample are shown in Tables 8 through 10. Each sample was tested at three different compactability values to measure various foundry properties. The samples were prepared according to the methods disclosed herein. The resulting desirable foundry properties are shown in Tables 5 through 7.

TABLE 8

Foundry Properties of Foundry Mold Compositions With a 35% Compactability Target and Additional Additives

| Sample ID | 13 | 14 | 15 | 16 |
|---|---|---|---|---|
| base clay | N.S. 200 | N.S. 200 | N.S. 200 | N.S. 200 |
| Binder in Sand (%) | 8.0 | 8.0 | 8.0 | 8.0 |
| Water in Sand (%) | 1.87 | 2.17 | 2.03 | 2.20 |
| MgO in Binder (%) | 2.0 | — | 2.0 | — |
| Dolomite Hydrate in Binder (%) | — | 2.0 | — | 2.0 |
| Gilsonite in Binder (%) | 2.0 | 2.0 | 1.5 | 1.5 |
| Coal in Binder (%) | 25.0 | 25.0 | 21.5 | 21.5 |
| Wood Flour in Binder (%) | — | — | 1.0 | 1.0 |
| Compactability (%) | 35.0 | 33.3 | 35.5 | 33.3 |
| Specimen Weight (grams) | 155.00 | 156.00 | 156.00 | 157.00 |
| Moisture (%) | 2.95 | 2.90 | 2.73 | 2.91 |
| Average Green Comp Str. (psi) | 23.9 | 24.0 | 24.5 | 24.2 |
| Total Dry Comp Str. (psi) | 55.8 | 55.9 | 57.3 | 52.4 |
| Permeability (psi) | 148 | 138 | 144 | 139 |
| Friability (%) | 14.35 | 17.86 | 15.51 | 15.35 |
| Moldability (%) | 93.67 | 95.57 | 94.71 | 93.71 |

TABLE 9

Foundry Properties of Foundry Mold Compositions With a 40% Compactability Target and Additional Additives

| Sample ID | 13 | 14 | 15 | 16 |
|---|---|---|---|---|
| base clay | N.S. 200 | N.S. 200 | N.S. 200 | N.S. 200 |
| Binder in Sand (%) | 8.0 | 8.0 | 8.0 | 8.0 |
| Water in Sand (%) | 2.17 | 2.33 | 2.20 | 2.40 |
| MgO in Binder (%) | 2.0 | — | 2.0 | — |

TABLE 9-continued

Foundry Properties of Foundry Mold Compositions With a 40% Compactability Target and Additional Additives

| Sample ID | 13 | 14 | 15 | 16 |
|---|---|---|---|---|
| Dolomite Hydrate in Binder (%) | — | 2.0 | — | 2.0 |
| Gilsonite in Binder (%) | 2.0 | 2.0 | 1.5 | 1.5 |
| Coal in Binder (%) | 25.0 | 25.0 | 21.5 | 21.5 |
| Wood Flour in Binder (%) | — | — | 1.0 | 1.0 |
| Compactability (%) | 42.5 | 37.5 | 40.8 | 40.8 |
| Specimen Weight (grams) | 155.00 | 156.00 | 157.00 | 157.00 |
| Moisture (%) | 2.86 | 3.13 | 2.92 | 3.23 |
| Average Green Comp Str. (psi) | 23.3 | 24.2 | 24.0 | 24.2 |
| Total Dry Comp Str. (psi) | 59.7 | 65.0 | 58.1 | 63.1 |
| Permeability (psi) | 158 | 140 | 148 | 141 |
| Friability (%) | 9.29 | 15.07 | 11.79 | 10.49 |
| Moldability (%) | 87.49 | 88.61 | 93.45 | 90.26 |

TABLE 10

Foundry Properties of Foundry Mold Compositions With a 45% Compactability Target and Additional Additives

| Sample ID | 13 | 14 | 15 | 16 |
|---|---|---|---|---|
| base clay | N.S. 200 | N.S. 200 | N.S. 200 | N.S. 200 |
| Binder in Sand (%) | 8.0 | 8.0 | 8.0 | 8.0 |
| Water in Sand (%) | 2.27 | 2.50 | 2.37 | 2.57 |
| MgO in Binder (%) | 2.0 | — | 2.0 | — |
| Dolomite Hydrate in Binder (%) | — | 2.0 | — | 2.0 |
| Gilsonite in Binder (%) | 2.0 | 2.0 | 1.5 | 1.5 |
| Coal in Binder (%) | 25.0 | 25.0 | 21.5 | 21.5 |
| Wood Flour in Binder (%) | — | — | 1.0 | 1.0 |
| Compactability (%) | 46.7 | 45.0 | 46.7 | 45.0 |
| Specimen Weight (grams) | 156.00 | 156.00 | 157.00 | 157.00 |
| Moisture (%) | 2.98 | 3.17 | 2.98 | 3.28 |
| Average Green Comp Str. (psi) | 21.9 | 23.0 | 22.5 | 23.2 |
| Total Dry Comp Str. (psi) | 64.9 | 68.8 | 60.2 | 71.0 |
| Permeability (psi) | 158 | 140 | 150 | 140 |
| Friability (%) | 7.93 | 9.49 | 9.13 | 8.13 |
| Moldability (%) | 86.17 | 85.55 | 78.57 | 73.87 |

The results demonstrate the improved foundry properties that may be obtained through the use of the foundry mold compositions, including the modifiers, disclosed herein.

Example 4

In order to demonstrate the rheological effects obtained by adding the modifiers disclosed herein to a composition, the five foundry mold compositions referred to in Example 2 were tested to determine their rheological properties. The first sample, labeled sample 8, contained only sand, a clay binder, and water in order to demonstrate an unmodified foundry mold composition. The next three samples, labeled samples 9, 10, and 11, contained a similar formulation with the addition of varying amounts of a calcium magnesium carbonate modifier in order to demonstrate the effects of the modifier in different concentrations. The last sample, labeled sample 12, contained the same formulation as sample 8 with the addition of a magnesium oxide modifier for comparison to the carbonate modifier. The rheological properties were measured using a Farm® viscometer model 35A, available from Fann Instrument Company, Houston U.S.A. The resulting rheological properties are shown in Table 11.

TABLE 11

Rheological Properties of Clay Mixtures Containing Metal Carbonate Modifiers

| Sample ID | 8 | 9 | 10 | 11 | 12 |
|---|---|---|---|---|---|
| Base Clay | N.S. 200 | N.S. 200 | N.S. 200 | N.S. 200 | N.S. 200 |
| D.I. water. bbl | 1 | 1 | 1 | 1 | 1 |
| lb/bbl clay blend | 22.5 | 22.5 | 22.5 | 22.5 | 22.5 |
| wt % dolomite hydrate | — | — | 1.75 | 2.00 | 2.25 |
| wt % MgO | — | 2.65 | — | — | — |
| Fann 35A readings: | | | | | |
| 600 rpm | 11.5 | 106.0 | 294.0 | 260.0 | 229.5 |
| 300 rpm | 7.0 | 106.0 | 275.0 | 245.0 | 211.0 |
| 200 rpm | 5.5 | 123.0 | 262.5 | 236.0 | 199.5 |
| 100 rpm | 3.5 | 99.0 | 242.0 | 216.5 | 182.0 |
| 6 rpm | 1.5 | 85.5 | 163.5 | 79.0 | 98.0 |
| 3 rpm | 1.0 | 91.0 | 106.0 | 80.0 | 63.5 |
| Plastic viscosity, cP | 4.5 | 0.0 | 19.0 | 15.0 | 18.5 |
| Yield point, lb/100 $ft^2$ | 2.5 | 106.0 | 256.0 | 230.0 | 192.5 |
| Apparent Viscosity, cP | 5.8 | 53.0 | 147.0 | 130.0 | 114.8 |
| TP/PV ratio | 0.6 | — | 13.5 | 15.3 | 10.4 |

Upon review of the above data, one of ordinary skill in the art should understand that the clay compositions formulated using the modifiers disclosed herein demonstrate improved rheological properties. In particular, the compositions formulated using the modifiers disclosed herein demonstrate enhanced rheological properties, including an increased plastic viscosity, yield point, and apparent viscosity relative to the base clay and the base clay with magnesium oxide.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Moreover, the indefinite articles "a" or "an," as used in the claims, are defined herein to mean one or more than one of the element that it introduces. Also, the terms in the claims have their plain, ordinary meaning unless otherwise explicitly and clearly defined by the patentee.

What is claimed is:

1. A method for producing a foundry mold comprising the steps of:

providing sand, water, and a binder wherein the binder comprises a smectite clay;

providing a modifier comprising at least one metal carbonate selected from the group consisting of: calcium magnesium carbonate boron carbonate, and lead carbonate;

forming a foundry mold composition by mixing the sand, the water, the modifier, and the binder;

introducing the foundry mold composition into a pattern defining a foundry mold;

consolidating the foundry mold composition within the pattern to form the foundry mold; and, removing the foundry mold from the pattern.

2. The method of claim 1 wherein the binder is present in the foundry mold composition in an amount greater than or equal to about 1% and less than or equal to about 15% by weight of the foundry mold composition.

3. The method of claim 1 wherein the modifier is present in the foundry mold composition in an amount greater than or equal to about 0.1% and less than or equal to about 20% by weight of the foundry mold composition.

4. The method of claim 1 wherein the modifier is present in the foundry mold composition in an amount greater than or equal to about 0.5% and less than or equal to about 5% by weight of the foundry mold composition.

5. The method of claim 1 wherein the sand comprises at least one material selected from the group consisting of: silica sand, olivine sand, chromite sand, zircon sand, carbon sand, ceramic sand, and a combination thereof.

6. The method of claim 1 wherein the sand is present in the foundry mold composition in an amount greater than or equal to about 40% and less than or equal to about 99% by weight of the foundry mold composition.

7. The method of claim 1 further comprising:

introducing molten metal into the foundry mold; and, allowing the molten metal to solidify to form a metal casting.

8. The method of claim 1 wherein the foundry mold comprises at least one mold selected from the group consisting of: a cope, a drag, a core, and a derivative thereof.

9. A method for producing a foundry mold comprising the steps of:

providing sand, water, and a binder wherein the binder comprises a smectite clay;

providing modifier comprising at least one metal carbonate selected from the group consisting of: boron, and lead;

forming a foundry mold composition by mixing the sand, the water, the modifier, and the binder;

introducing the foundry mold composition into a pattern defining a foundry mold;

consolidating the foundry mold composition within the pattern to form the foundry mold; and, removing the foundry mold from the pattern.

10. The method of claim 9 wherein the binder is present in the foundry mold composition in an amount greater than or equal to about 1% and less than or equal to about 15% by weight of the foundry mold composition.

11. The method of claim 9 wherein the modifier is present in the foundry mold composition in an amount greater than or equal to about 0.1% and less than or equal to about 20% by weight of the foundry mold composition.

12. The method of claim 9 wherein the modifier is present in the foundry mold composition in an amount greater than or equal to about 0.5% and less than or equal to about 5% by weight of the foundry mold composition.

13. The method of claim 9 wherein the sand comprises at least one material selected from the group consisting of: silica sand, olivine sand, chromite sand, zircon sand, carbon sand, ceramic sand, and a combination thereof.

14. The method of claim 9 wherein the sand is present in the foundry mold composition in an amount greater than or equal to about 40% and less than or equal to about 99% by weight of the foundry mold composition.

15. The method of claim 9 wherein comprising:

introducing molten metal into the foundry mold; and, allowing the molten metal to solidify to form a metal casting.

16. A method for producing a foundry mold comprising the steps of:

providing sand, water, and a binder wherein the binder comprises a smectite clay;

providing a modifier comprising calcium magnesium carbonate;

forming a foundry mold composition by mixing the sand, the water, the modifier, and the binder;

wherein the binder is present in the foundry mold composition in an amount greater than or equal to about 1% and less than or equal to about 15% by weight of the foundry mold composition;

wherein the modifier is present in the foundry mold composition in an amount greater than or equal to about 0.5% and less than or equal to about 5% by weight of the foundry mold composition; and, wherein the sand is present in the foundry mold composition in an amount greater than or equal to about 40% and less than or equal to about 99% by weight of the foundry mold composition;

introducing the foundry mold composition into a pattern defining a foundry mold;

consolidating the foundry mold composition within the pattern to form the foundry mold; and, removing the foundry mold from the pattern.

* * * * *